US008104419B2

(12) United States Patent
Coupeaud et al.

(10) Patent No.: US 8,104,419 B2
(45) Date of Patent: Jan. 31, 2012

(54) DEVICE FOR AUTOMATICALLY ATTACHING AND DETACHING A TOWED SONAR TRANSMITTER TO AND FROM AN ACTIVE-SONAR TOW LINE

(75) Inventors: Christophe Coupeaud, St. Medard en Jalles (FR); Jean-Philippe Goudeau, Le Rouret (FR)

(73) Assignee: Thales, Neuilly sur Seine (FR)

( * ) Notice: Subject to any disclaimer, the term of this patent is extended or adjusted under 35 U.S.C. 154(b) by 76 days.

(21) Appl. No.: 12/445,315

(22) PCT Filed: Oct. 11, 2007

(86) PCT No.: PCT/EP2007/060853

§ 371 (c)(1),
(2), (4) Date: Aug. 19, 2009

(87) PCT Pub. No.: WO2008/043823

PCT Pub. Date: Apr. 17, 2008

(65) Prior Publication Data

US 2010/0064955 A1 Mar. 18, 2010

(30) Foreign Application Priority Data

Oct. 13, 2006 (FR) ..... 06 08998

(51) Int. Cl.
*B63B 21/04* (2006.01)

(52) U.S. Cl. ..... 114/253

(58) Field of Classification Search ..... 114/253; 405/172, 184.4

See application file for complete search history.

(56) References Cited

U.S. PATENT DOCUMENTS

| | | | | |
|---|---|---|---|---|
| 5,269,629 | A * | 12/1993 | Langner | 405/195.1 |
| 5,752,460 | A | 5/1998 | Buffman et al. | |
| 5,986,975 | A * | 11/1999 | Bauer et al. | 367/106 |
| 6,835,025 | B1 * | 12/2004 | Beard et al. | 405/184.4 |
| 7,373,986 | B2 * | 5/2008 | Pollack et al. | 166/359 |
| 2006/0042145 | A1 * | 3/2006 | Lou | 43/15 |

FOREIGN PATENT DOCUMENTS

| | | | |
|---|---|---|---|
| EP | 0146336 | A | 6/1985 |
| EP | 0880033 | A2 | 11/1998 |
| WO | WO-2004/039666 | A | 5/2004 |

* cited by examiner

*Primary Examiner* — Stephen Avila
(74) *Attorney, Agent, or Firm* — Stroock & Stroock & Lavan LLP

(57) ABSTRACT

The present invention relates to the handling, the attaching to a drag line and the putting to sea of a submersible craft, dragged by a surface vessel. The invention includes a system for automatically attaching and handling submersible craft towed by a tow line, comprising an automatic attaching device for carrying out the mechanical attaching of the submersible craft to the drag line and the linking of the submersible craft to the structure conveying the signals and the energy in this same line. The system according to the invention also includes an automatic device for handling the submersible craft, on which device the submersible craft is positioned when it is not attached to the drag line and from which it is separated after attachment, and which makes it possible to automatically position the submersible craft with respect to the drag line in such a way that the attaching and detaching can likewise be done automatically. The invention applies to towed active sonars in which the transmission antenna is integrated into a submersible craft and the reception antenna includes a linear antenna (streamer) towed behind the submersible craft.

15 Claims, 11 Drawing Sheets

Section A-A Section B-B

Section A-A

Section B-B

DEVICE FOR AUTOMATICALLY ATTACHING AND DETACHING A TOWED SONAR TRANSMITTER TO AND FROM AN ACTIVE-SONAR TOW LINE

This is a U.S. National Phase Application under 35 U.S.C. §371 of International Application no. PCT/EP2007/060853, filed Oct. 11, 2007, and claims benefit of French Patent Application No. 06 08998, filed Oct. 13, 2006, both of which are incorporated herein. The International Application was published in French on Apr. 17, 2008 as WO/2008/043823 under PCT Article 21 (2).

The present invention relates to variable-immersion active sonars, dragged by a surface vessel. It relates more particularly to towed active sonars taking the form of bistatic systems in which the transmission antenna is integrated into a submersible object or "Fish" and the reception antenna includes a linear antenna (streamer) towed behind the fish. Such a tow line is said to be dependent since the fish and the linear reception antenna are secured to one and the same line.

Figure 1:
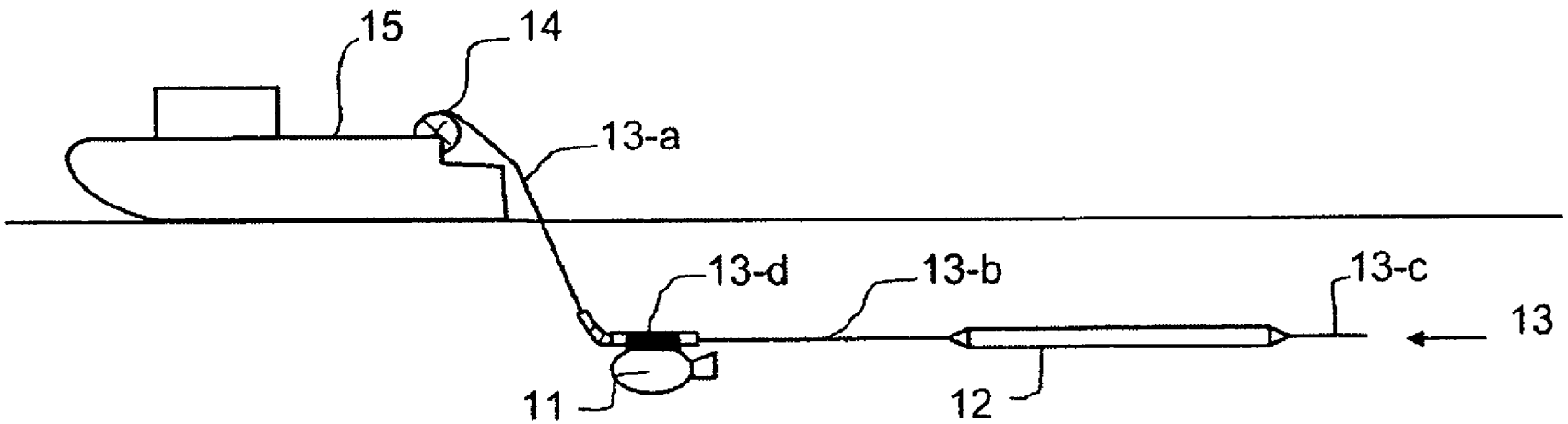

The implementation of such a sonar, represented schematically in FIG. 1, includes two handling steps, including launching the sonar into the sea and recovering the sonar and storing it on the drag vessel.

On surface vessels, linear reception antennas are traditionally stored on a winch, for obvious space reasons.

Hence, launching an active sonar into the sea, said sonar comprising at one and the same time a transmission antenna mounted in a dragged submersible craft, also called a "fish", and a linear reception antenna, includes first of all in unwinding the antenna by operating the winch and in letting the antenna settle down at the extremity of the towing cable. It thereafter includes in mechanically and electrically coupling the fish to the tow line then in launching the fish into the sea with the aid of arbitrary lifting and handling means.

Conversely, bringing such a sonar back aboard the surface vessel includes firstly in hauling in the tow line, then in removing the fish from the water and in depositing it on the deck of the vessel, then further in uncoupling the fish from the line. When the fish is uncoupled, the linear antenna which follows is dragged aboard and wound on the winch.

The implementation of such a sonar therefore includes a certain number of attaching and detaching operations, carried out manually, which according to the weight of the transmitter may require the mobilization of a greater or lesser number of operators. Now, when the state of the sea is difficult, in heavy weather, such operations, generally performed by crew members from the rear platform of the vessel, may turn out to be very tricky, taxing, or even perilous for these men, so that the implementation of the sonar may be made impossible for safety reasons. The implementation of such a system furthermore requires precise pinpointing, by way of marking on the drag cable for example, of the position of the fish with respect to the handling platform, so as in particular to know when the fish is in the position which induces the stoppage of hauling and loading aboard, which operation also requires human intervention.

To circumvent these difficulties of implementation, a known solution consists in storing on two separate reels the electric drag cable which remains attached to the fish and the linear reception antenna. In this way, the sonar is launched into the water by completely unwinding the linear reception antenna (i.e. the "streamer") into the sea and by mechanically and electrically linking the emerged end of the streamer to the fish, after unwinding and before complete immersion. Once the linking has been performed the fish, fastened to the streamer, is cast into the sea by unwinding the electric drag cable.

In this configuration, the attaching and detaching operations are somewhat simplified. Nevertheless such a configuration which requires the use of two reels placed on the rear platform of the vessel, a platform moreover of limited dimensions, turns out to be cumbersome. Moreover, it still requires accurate knowledge of the position of the fish with respect to the platform and of the instant marking the end of the unwinding of the streamer, and therefore still requires the intervention of human operators.

An aim of the invention is to solve the problem posed by the necessity to resort to human interventions. For this purpose, the subject of the invention is a system for automatically attaching and connecting a submersible object, or "Fish", comprising at least one transmission antenna, towed by a tow line, said fish being able to contain a sonar transmitter or, at the very least, a transmission antenna. The system includes at least one automatic attaching device for carrying out in an automatic manner the mechanical attaching of the transmitter to a drag line and the linking of this fish to a structure conveying signals and energy in this same line.

According to a characteristic of the invention, the automatic attaching device includes a male element secured to the drag line and a female element secured to the fish. The male element and the female element are configured to fit one in the other, so that the drag line can be automatically inserted into the female element and so that, the insertion of the male element into the female element being carried out by the sliding of the line into the female element, the fitting of the male element into the female element secures the female element to the drag line.

According to another characteristic of the invention, the male element and the female element of the automatic device for attaching the transmitter to the drag line include connectors, able to plug into one another.

According to another characteristic of the invention, the male element and the female element of the automatic device for attaching the fish to the drag line furthermore include automatic centering and positioning means, these centering and positioning means being configured and arranged so that the insertion of the male element into the female element ensures the positioning of the connectors of the male element opposite the connectors of the female element and the plugging in of the connectors placed opposite.

According to another characteristic of the invention, the female element of the automatic attaching device forms a tubular cavity able to receive the male element, which cavity includes two axial openings of which at least one possesses a sufficient cross section to allow the axial insertion of the male element and a lateral opening whose width, substantially equal to the diameter of the line, allows the insertion of the drag line inside the cavity.

According to another characteristic of the invention, the male element of the automatic attaching device possesses a greater cross section than the cross section of the drag line on which it is inserted so that it is impossible for it to pass through the lateral opening of the female element.

According to another characteristic of the invention, the automatic centering and positioning means of the automatic attaching device are configured and designed to cause, in the case where the relative orientation of the two elements, one with respect to the other, during the insertion of the male element into the female element does not allow the connectors to be placed opposite one another, a relative rotational movement of the male element and of the female element so as to orient the two elements one with respect to the other in an appropriate manner.

According to another characteristic of the invention, the automatic positioning and centering means of the automatic attaching device include finger-like structures implanted respectively on the periphery of the male element and on the internal wall of the cavity of the female element. The finger-like structures of the male element are configured to be housed in the spaces separating the finger-like structures of the female element when the male element is inserted into the female element.

According to another characteristic of the invention, the finger-like structures implanted on the male element have a different end profile from that of the finger-like structures implanted on the female element so that, the structures implanted on the male element being placed opposite the structures implanted on the female element, the bringing together of the two structures necessarily causes the first structures to glide over the second structures.

The system according to an embodiment of the invention can also include an automatic device for handling the fish, said device comprising the following means:

- a carrier chassis fixed to the handling platform of the vessel,
- a mobile support on which the transmitter is positioned when it is not attached to the drag line and from which it is separated after attachment,
- displacement means, for displacing horizontally and vertically and for guiding the support from a standby position to a position allowing the automatic attaching of the fish to the drag line or conversely from this position to the standby position,
- means for releasing the fish from its mobile support when the latter is attached to the drag line and for replacing the transmitter on the support after detachment, the device being positioned in a fixed manner on the handling platform.

According to a characteristic of the invention thus defined, the means for displacing the automatic handling device include at least:

- a motor,
- a first gang and a second gang of lateral glideways, placed on either side of the mobile support, comprising various segments, AB, BC and CD for the first gang and AB, BC for the second gang. Each glideway of each of the gangs includes abutments at its ends, the segments AB and BC are rectilinear segments and the segment CD is a curved segment, According to this characteristic, the means for displacing the automatic handling device are arranged in such a way that they cooperate so that the mobile support, gliding along the glideways, firstly follows a horizontal translational movement, between two points A and B, then a vertical translational movement between two points B and C; and then finally, the abutments situated at the points C of the glideways of the second gang forming a rotation spindle, a movement of rearward tilting between two points C and D of the glideways of the first gang.

According to another characteristic of the invention, the mobile support of the automatic handling device includes means for maintaining the fish in place when the support is in the untilted position.

According to another characteristic of the invention, the means for maintaining the fish in place are notches made in the flanks of the mobile support.

According to another characteristic of the invention, the motor of the automatic handling device is a controlled ram, one end of which is fixed to the chassis of the device and the other end of which is fixed to the support.

According to another characteristic of the invention, the mobile support includes means constituting a curved groove which comes into position under the drag line when the support is in the tilted position, to guide the drag line and limit its curvature.

The system according to an embodiment of the invention exhibits the advantage of allowing the automatic attaching of the fish onto the drag line and the automatic connection of the fish to the system, which connection can be electrical, optical and/or pneumatic, as the case may be. The implementation of the sonar is thus possible without risk for the crew, even in rough sea. It also advantageously makes it possible to facilitate the placing of the sonar in the sea by guiding the drag line as soon as the fish is mounted on the line. Moreover the room necessary for installing and implementing the device according to an embodiment of the invention is advantageously limited, the handling system being fixed to the platform and not itself requiring any handling during its implementation.

Figure 2:
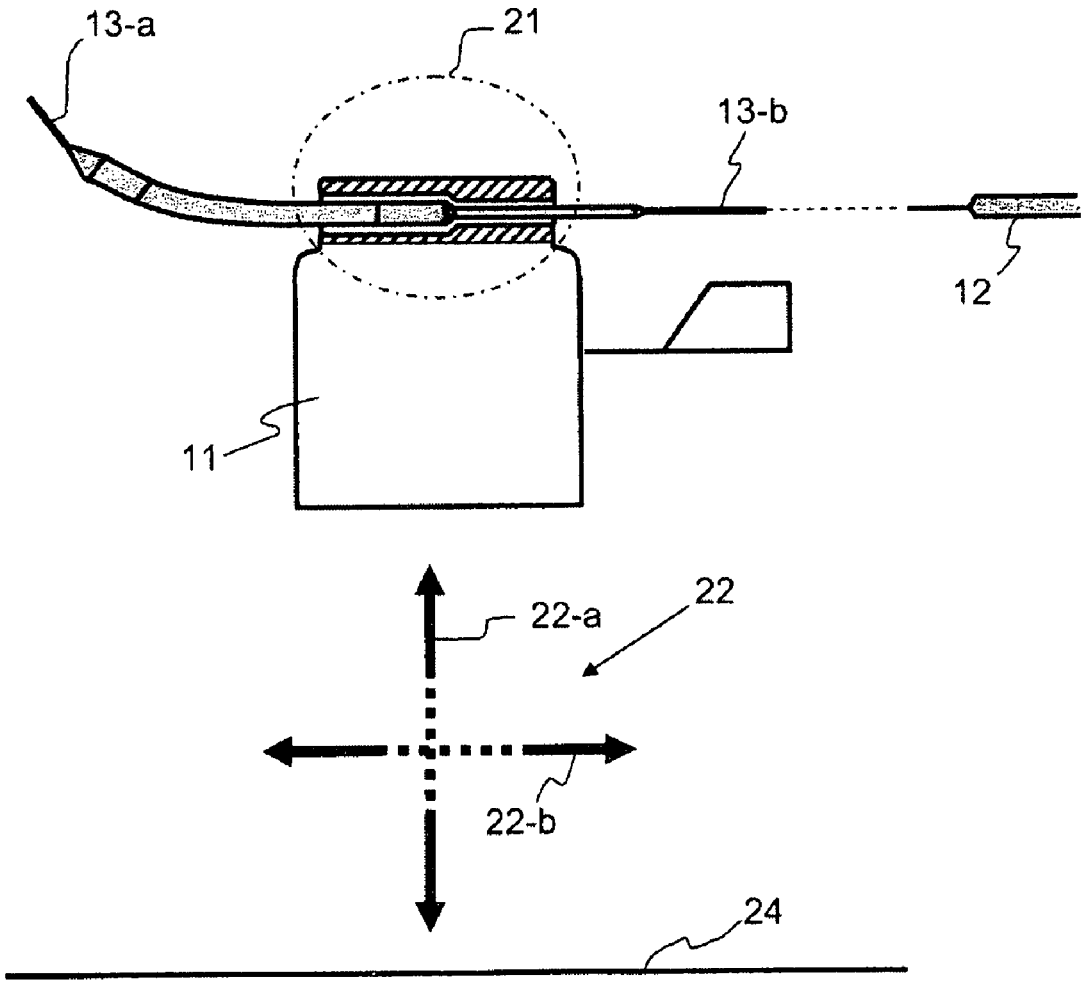

The advantageous characteristics of embodiments of the invention will be clearly apparent on reading the detailed description which follows, which detailed description is illustrated by the indexed figures which represent:

FIG. 1, an illustration which presents in a schematic manner a nonlimiting example of a sonar system whose implementation can be carried out by means of an embodiment of the invention, FIG. 2, a schematic illustration of the structure and of the operating principle of the system according to an embodiment of the invention, FIGS. 3 to 8, illustrations of the structure and of the operating principle of the automatic attaching device of the system according to an embodiment of the invention, FIGS. 9 to 12, illustrations of the structure and of the operating principle of the automatic handling device of the system according to an embodiment of the invention.

Attention is first turned to FIG. 1 which illustrates in a schematic manner the difficulties presented when launching into the water and recovering an active sonar such as that to which the system according to an embodiment of the invention is, in particular but in a nonlimiting manner, addressed. It should be noted that for obvious practical reasons the dimensions of the various elements in FIG. 1 are not to the same scale.

An active sonar includes a known manner of transmission means 11 and of reception means 12. The transmission and reception means are dragged from a vessel 15, a surface ship for example, by means of a drag line 13 (13-*a*, 13-*b*, 13-*c* and 13-*d*), or else electric-drag cable, which ensures at one and the same time the mechanical dragging of the sonar and the trunking of the signals and power supplies from the vessel to the sonar and vice versa, through the corresponding transport structure, cable, fiber or other. The transmission 11 and reception 12 means are mechanically attached onto the line 13 in an appropriate manner. Likewise, these means are electrically (or optically) connected to the drag line 13.

In a conventional manner, the reception means includes a linear antenna, of streamer type, of tubular form identical to those found in passive sonars, while the transmitter is integrated into a voluminal structure also called a "fish". The reception streamer is generally disposed at the rear, level with the end of the drag line, the fish being positioned on the part of the line closest to the ship.

The linear reception antenna 12 is generally attached in a permanent manner to the drag line 13, although the fish is for its part attached in a removable manner. For this purpose the drag line includes a zone for attaching the fish 13-*d*, in which zone are implanted means for mechanically fixing the fish to the line and for linking it to the structure, a cable for example, conveying the signals and the energy (power supplies) in the line. In this way, at the level of the carrier vessel which accommodates the sonar, the sonar is launched into the sea and recovered by means of a winch 14 whose drum is dimensioned so as to allow the drag line 13 and the linear reception antenna 12 to be wound up. The winding of the start 13-*a* of the drag line 13 makes it possible to drag the fish 11 aboard, onto the rear platform of the ship for example. The fish should then be uncoupled from the drag line 13 and moved to its storage area to enable the line portion situated between the fish 11 and the reception antenna 12 to be wound up.

Conversely, when placing the sonar in the water, first the linear reception antenna and the portion 13-*b* of line situated at the rear of the fish are launched into the water, then the unwinding of the line is interrupted when the attachment zone becomes accessible and then the fish 11 is attached to the line 13 and is linked to the structure, a cable for example, conveying the signals and the energy (power supplies) in the line. The unwinding of the line is thereafter resumed to enable the fish and the proximal portion (i.e. the closest to the carrier vessel) of the line (segments 13-*a* and 13-*d*) onto which the fish is attached to be launched into the sea.

Such a hardware structure has the advantage of comprising distinct transmissions and reception means thereby in particular affording, in a simple manner, omnidirectional transmission means. However, as was stated previously, this structure requires for its implementation a large number of handling operations which are currently carried out by crew members in sometimes precarious safety conditions. Such is in particular the case for the operations of attaching, detaching and handling the fish from (or to) its storage area. As was also stated previously, the aim of the invention is to eliminate or at the very least to limit human interventions as far as possible.

The illustration of FIG. 2 presents in a schematic manner the object of an embodiment of the invention, which includes a system comprising a device 21 making it possible to ensure in an automatic manner the attaching of the fish 11 to the line 13 as well as the linking thereof to the structure, a cable for example, conveying the signals and the energy (power supplies) in the line, with which device may be associated an automatic device 22 for handling the fish, a device symbolized by the semi-dashed arrows 22-*a* and 22-*b*.

Figure 3:
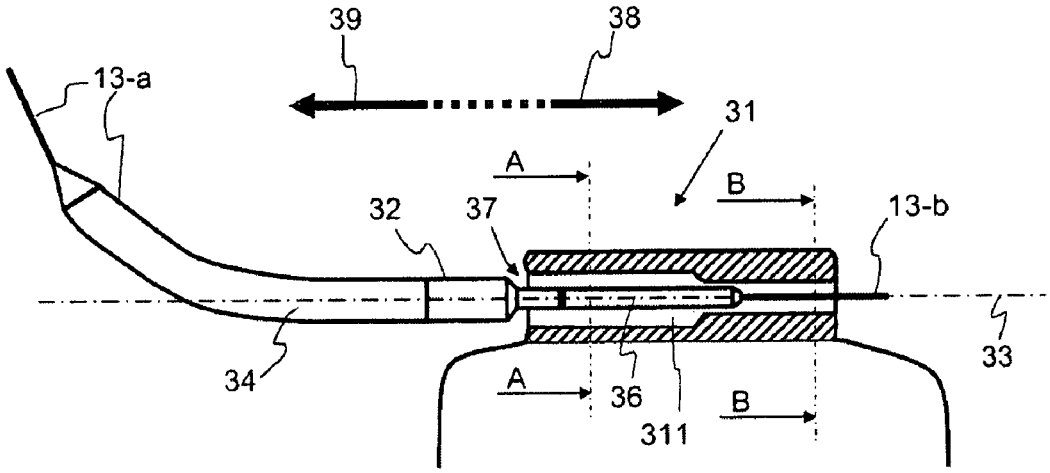
Figure 3:
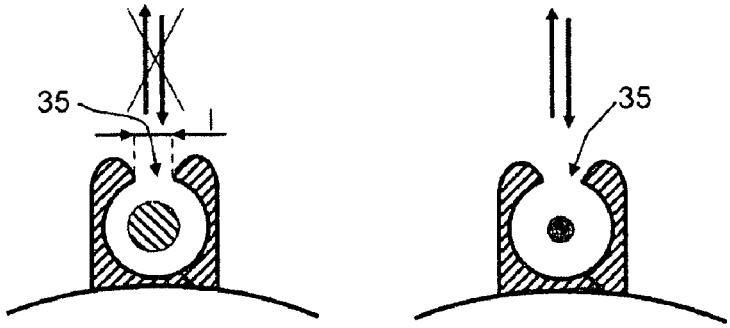
Figure 4:
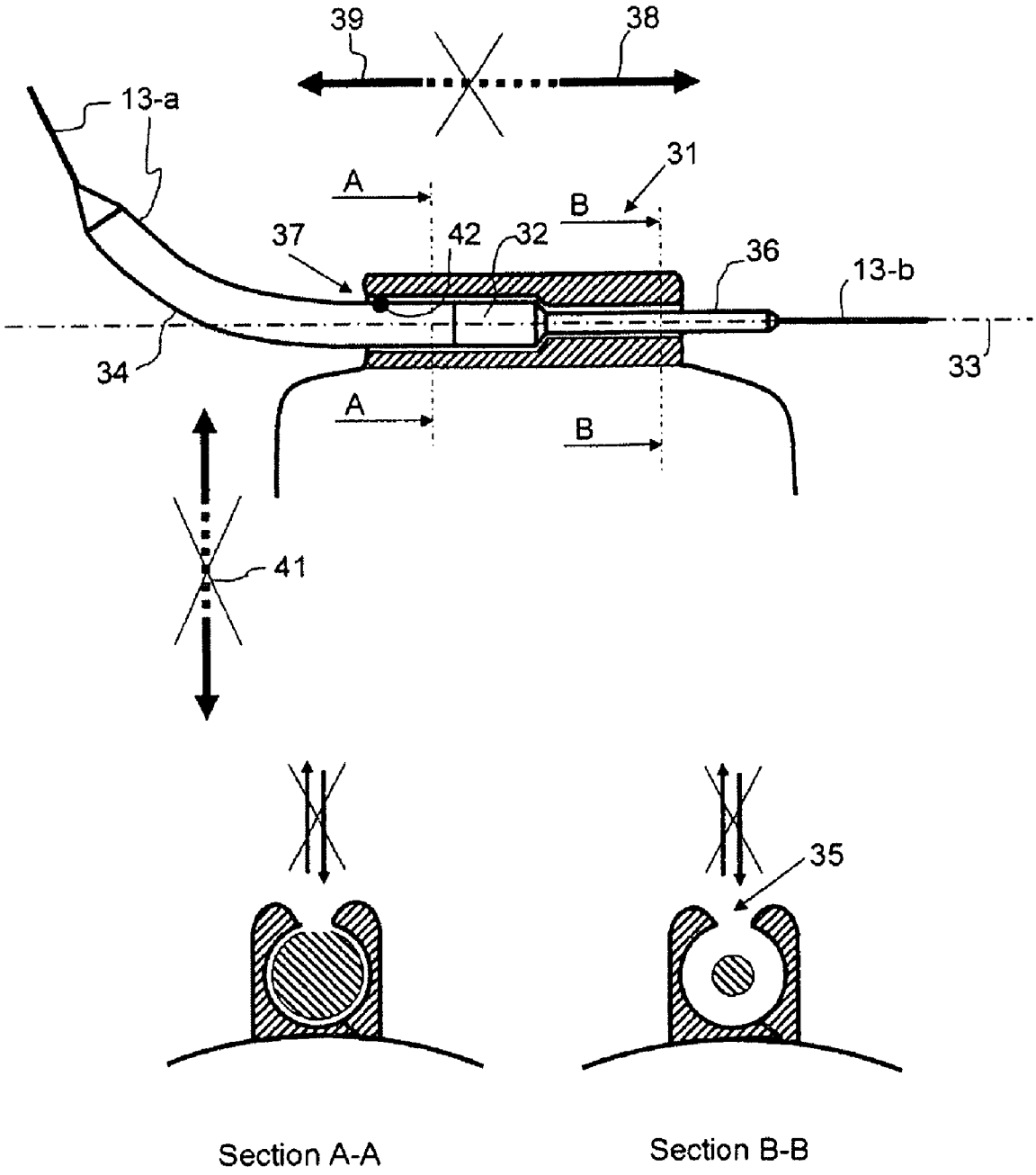

Attention is next turned to FIGS. 3 to 8 which describe in schematic form the general structure and the operating principle of the automatic device for attaching the fish (i.e. the transmitter) to the drag line. FIGS. 3 and 4 are considered initially.

According to an embodiment of the invention, the automatic attaching and linking device 21 include, as shown by FIG. 3, two distinct elements, a female element 31 secured to the fish 11, or more generally to the transmitter, and a male element 32 secured to the line 13 and whose axis of symmetry coincides with the axis of the line 33. The female element 31 exhibits a tubular cavity whose length is at least equal to the length of the male element 32 and whose cross section corresponds, at least for the part of the cavity into which the male element 32 is inserted, to that of this element. The cross section is preferably narrower over the remainder of the length. Thus, for example, if the male element 32 exhibits a substantially cylindrical form as illustrated by FIG. 3, the cavity afforded by the female element will be of cylindrical cross section.

According to an embodiment of the invention, the male element 32 exhibits a cross section of markedly greater size than the cross section of the portion 13-*b* of the line 13 situated behind the attachment zone 13-*d* for the fish. In the embodiment illustrated by FIG. 3, the male element 32 is of a diameter equal to that of the curvature limiting device 34 with which the portion 13-*a* of the line is equipped and secured to said device. The same holds for the diameter of the cross section of the cavity including the female element 31. Furthermore, the female element 32 exhibits over its entire length a lateral longitudinal opening 35, visible in the cross sections A-A and B-B of FIG. 3. The width I of this opening is sufficient to allow a line element whose diameter does not exceed I to fit through this opening into the cavity of the element 31. On the other hand, the width of this opening is insufficient to allow a line cross section of a diameter greater than I to enter or to exit the cavity through the lateral opening 35.

Thus in the exemplary embodiment of FIG. 3 the cross sections A-A and B-B show that it is possible to insert the line into the female element through the opening 35 when the female element is situated opposite a standard line portion, the portion 13-*a* for example, although insertion through the opening 35 is not possible when the female element is situated for example opposite the portion of the line 13 corresponding to the insertion zone 13-*d* constituted in the figure by the male element 32 and the curvature limiting element 36.

Accordingly, the insertion of the male element 32 into the female element 31, and therefore the mechanical attaching of the fish to the drag line, can therefore be carried out only by proceeding as follows:

- the female element 31 is positioned opposite the line portion 13-*b*,
- the line 13 is inserted into the female element 31 through the lateral opening 35: the diameter of the line being less than I, insertion is possible,
- the line 13 is slipped into the cavity of the female element 31 in the direction depicted by the arrow 38, so that the male element 32 penetrates fully into the cavity of the female element 31 through the axial opening 37 whose diameter is suited to that of the male element 32 and in any event sufficient to allow it to enter the cavity.

On completion of this insertion operation the line 13 can no longer exit the cavity formed by the female element 31 through the lateral opening 35 so that the fish is well attached to the line, as illustrated by the crossed-out double arrow of FIG. 4.

As illustrated by FIG. 4, the mooring mechanism thus formed can furthermore be advantageously supplemented with a latching mechanism 42 mounted on the female element, a mechanism of pin type for example, advantageously allowing the blocking of any translational movement of the female element along the line.

Conversely, the mechanical detaching of the fish can take place only by proceeding, after unlocking an optional latching mechanism 42, as follows

- the line 13 (after optional unlatching) is slipped into the cavity of the female element 31 in the direction depicted by the arrow 39, until the male element 32 exits the cavity of the female element 31 through the axial opening 37 and until the female element 31 is positioned opposite the line portion 13-*b*, the drag line 13 is extracted from the cavity of the female element through the lateral opening 35: the diameter of the line portion 13-*b* line being less than I, extraction is possible.

Therefore, by virtue of the physical characteristics of the male 32 and female 31 elements of the system according to an embodiment of the invention it is advantageously possible, provided that the fish is positioned in an appropriate manner with respect to the line, to automatically attach and detach the fish on the line. The attaching and detaching operation is thus carried out by simple threading or unthreading of the fish on the line.

Figure 5:
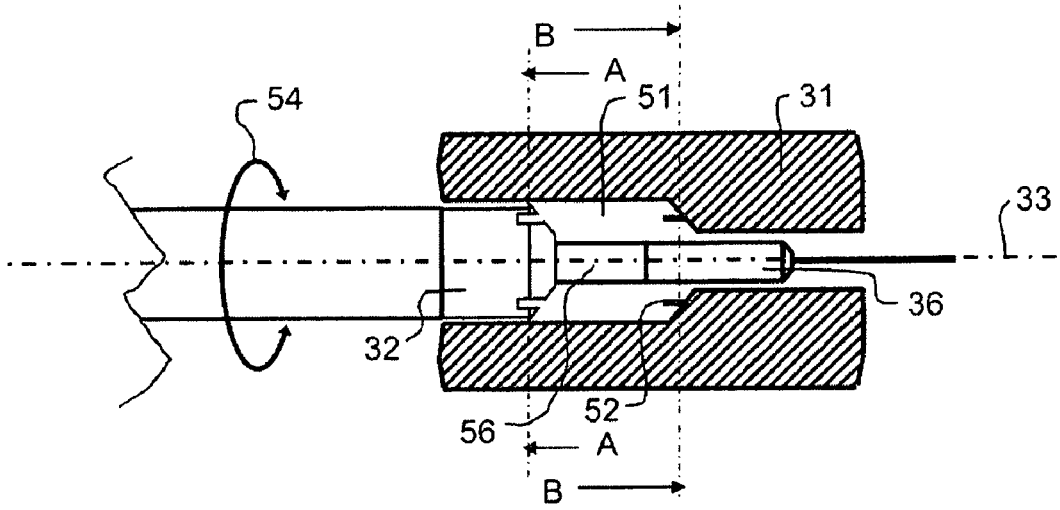
Figure 5:
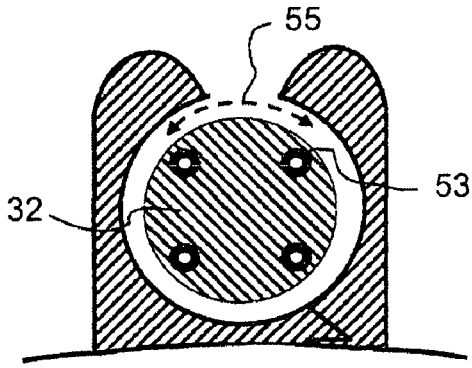
Figure 5:
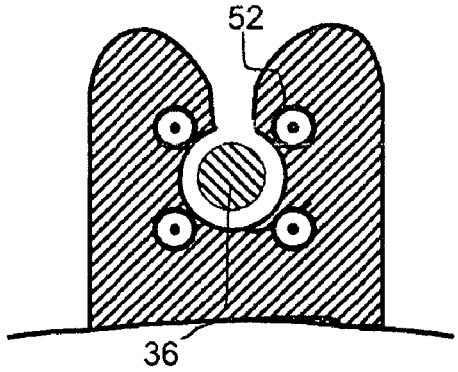
Figure 6:
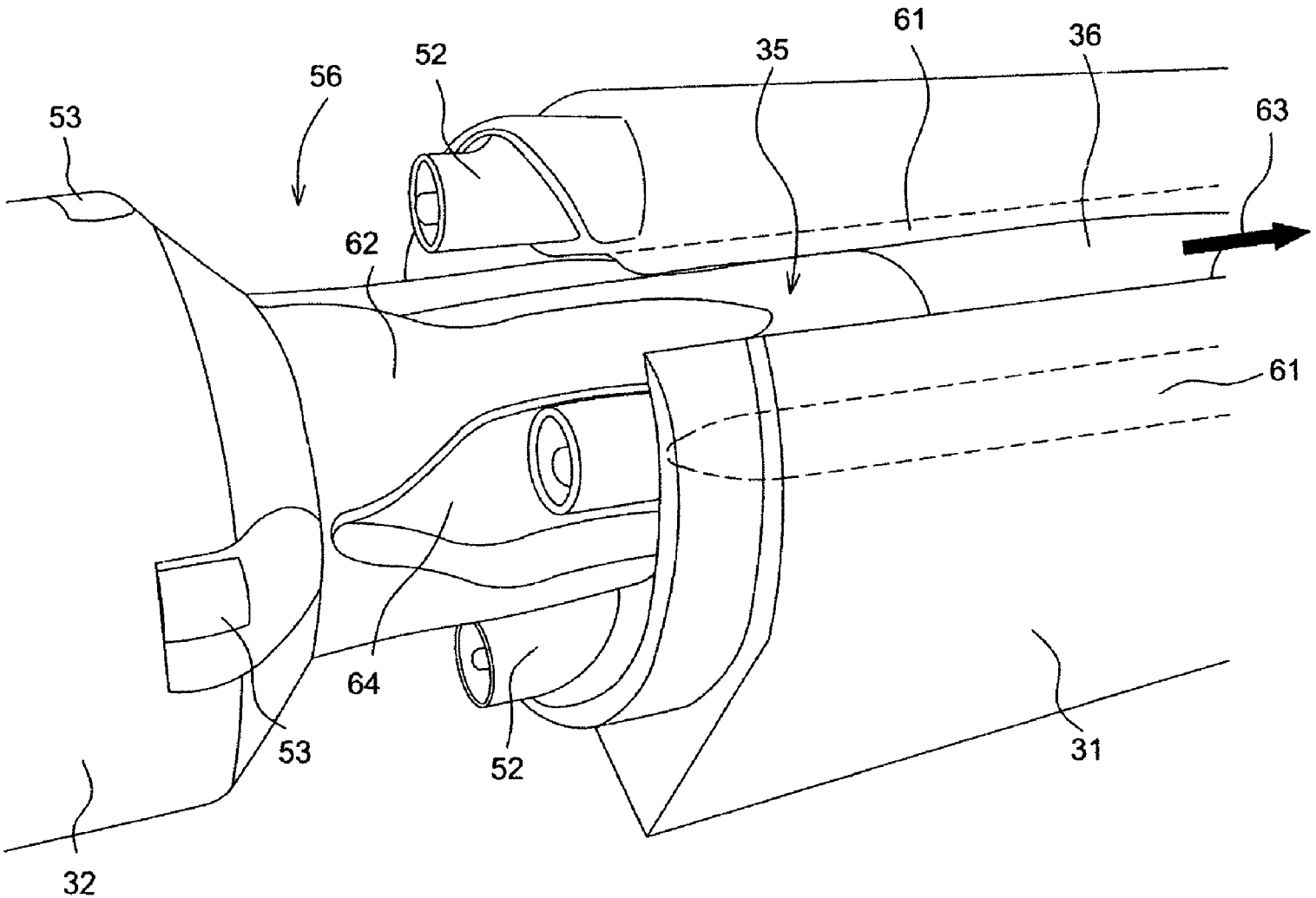
Figure 7:
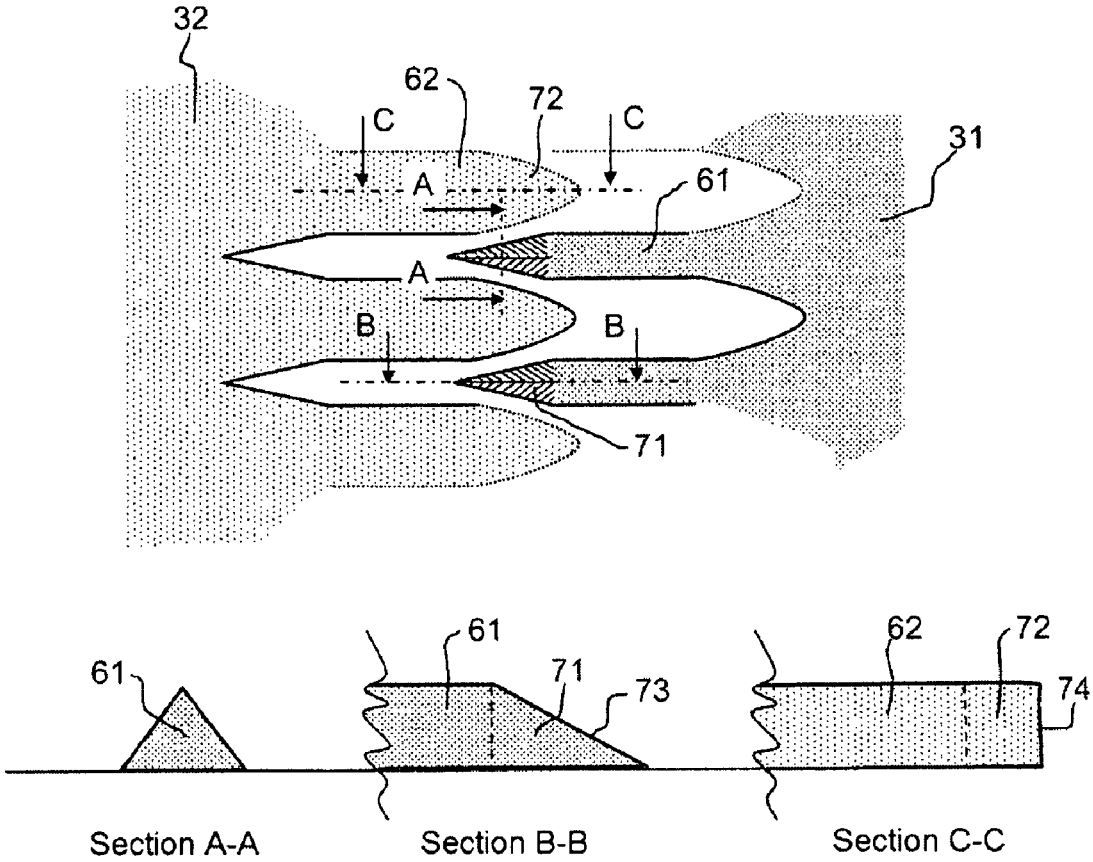

Attention is now turned to FIGS. 5 to 7 which present in schematic form, through a nonlimiting exemplary embodiment, the advantageous technical characteristics of an embodiment of the invention, which make it possible to carry out in an automatic manner the linking of the fish 11 to the structure conveying the signals and the energy (power supplies) in the drag line 13.

According to an embodiment of the invention, as illustrated by FIG. 5, the female element 31 includes, on the part of the wall of the internal cavity 51 intended to come into frontal contact with the male element 32, a series of male connectors 52, preferably disposed regularly around the periphery of the cavity, as illustrated by the cross section B-B.

In a symmetric manner the male element 32 includes on its frontal part a series of female connectors 53, identical in number to the connectors 52 of the female element and complying with a layout symmetric to that adopted for the connectors of the female element. Thus, placing a male connector 52 opposite a female connector 53 ensures that all the connectors are placed opposite one another. Linking to the structure conveying the signals and the energy can thus advantageously be carried out in a manner simultaneous with the mechanical attaching of the transmitter onto the line. Accordingly, it suffices that, when the element 31 is completely inserted into the element 32, the connectors are positioned opposite one another, such as illustrated in FIG. 5.

In order to place the male and female connectors opposite one another it may in many cases be necessary to apply a torsion to the drag line, a torsion indicated in FIG. 5 by the double circular arrows 54 and 55. Indeed, when placing the sonar in the water for example the unwinding of the drag line may lead the latter to take an arbitrary orientation about its axis of symmetry 33 so that the male element 32 and the female element 34 also exhibit an arbitrary relative orientation preventing the insertion of the male connectors 52 into the female connectors 53. Likewise, when the sonar is being recovered aboard, the drag line may, for various reasons such as the movements of the reception antenna for example, be wound onto the drum of the winch with an arbitrary orientation of the element 32.

According to an embodiment of the invention, the automatic attaching device includes automatic positioning and orientation means which make it possible in particular to ensure a relative orientation of the male element 32 in relation to the female element 31 which places the connectors 51 of the element 31, male connectors for example, opposite the connectors 52 of the element 32, female connectors in this case. The basic structure of these means is illustrated by the exemplary embodiment of FIG. 6.

The illustration of FIG. 6 presents in a schematic manner an exemplary embodiment of the means 21 of automatic attaching of the fish, which means carrying out the mechanical attaching and linking to the structure conveying the signals and the energy. In this exemplary embodiment, the male element 32 includes a front part 56, extended by the curvature limiter 36, which part includes positioning and orientation structures 62, in the form of fingers, disposed right around the front part 56. In parallel, the female element 31 also includes positioning and orientation elements 61 in the form of fingers, represented dashed in the figure, whose size and layout around the periphery of the cavity defined by the element 31 are such that, when the male element 32 is completely inserted into the female element 32, each element 61 occupies the free space 64 between two elements 62. This relative positioning of the elements 61 and 62 advantageously ensures that the connectors 52 and 53 are placed opposite one another automatically.

In a more general manner, the technical positioning and orientation effect can be ensured by profiled structures 62 of a form comparable with the form of a finger disposed around the periphery of the male element 52 and associated in an appropriate manner with profiled structures 61 of a form also comparable with the form of a finger disposed on the internal wall of the female element 51.

In order to facilitate the positioning and orientation action that they exert and to limit their deformation following repeated use, the elements 61 and 62 according to an embodiment of the invention take suitable forms.

Figure 8:
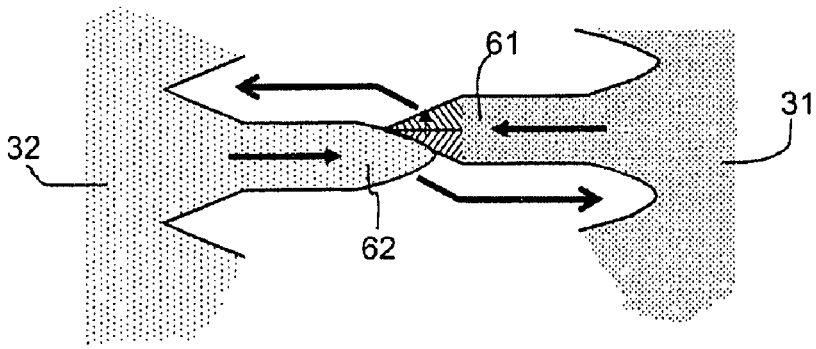

Thus, as illustrated schematically by FIG. 7, the positioning and orientation elements 61 and 62 have oblong forms able to facilitate the gliding of the elements one against another and ends 71 and 72 which ensure that even in a configuration where the fingers 61 and 62 are perfectly opposite one another at the start of the insertion of the male element 32 into the female element 31, the respective profiles of the ends of these elements prevent frontal blocking and lead them naturally to glide against one another while inducing a rotation of the male element 32 with respect to the female element 31. For this purpose the walls of the end 72 of the elements 62 form two planes whose intersection defines a vertical edge 74, while the walls of the elements 61 forms two planes whose intersection defines an oblique edge 73. FIG. 8 illustrates the advantageous effect afforded by this configuration allowing automatic centering by insertion without risk of blocking. An appropriate orientation of the male element with respect to the female element is thus obtained automatically.

Thus, with the automatic attaching and linking device 21 according to an embodiment of the invention, such as described in the preceding paragraphs, it is advantageously possible, provided that the relative positioning of the fish (or more generally of the transmission means) and of the drag line so allows, to perform in an automatic manner, without human intervention, the mechanical attaching of the fish to the drag line and the linking of the fish to the electrical, optical or else pneumatic link associated therewith. Accordingly, it suffices that the line is inserted into the tubular cavity 311 of the female element 31 while the latter is situated opposite the portion 13-*a* of the line 13, then to slide the line 13 inside the cavity 311 in the direction indicated by the arrow 63 of FIG. 6, until the male element 32 carried by the line 13 becomes completely inserted into the female element 31 carried by the fish.

Conversely, the electrical and/or optical, and/or pneumatic isolation of the fish with respect to the line and its mechanical detachment are then performed in an automatic manner by sliding the drag line in a direction opposite to that indicated by the arrow 63.

Attention is now turned to FIGS. 9 to 12 which present the characteristics of the automatic handling device 22 of the system for launching into the water and recovery according to an embodiment of the invention.

Figure 9:
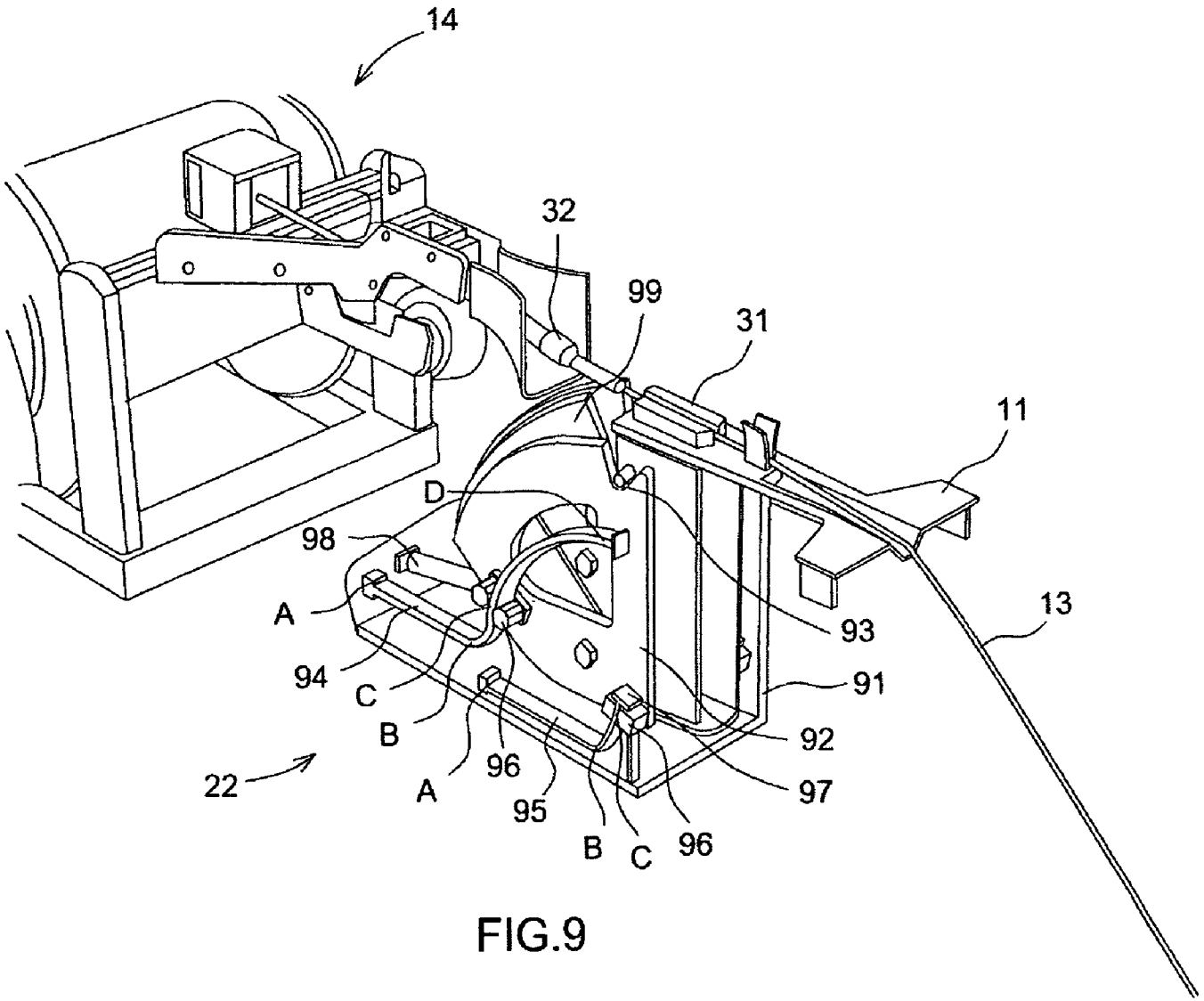

As illustrated by the exemplary embodiment of FIG. 9, the main role of this device when launching the sonar into the sea is to position the fish 11 opposite in relation to the line 13 and when the part 13-A of the line is unwound from the winch to raise the fish in such a way that the line is engaged in the tubular cavity 311. In this way, the line 13 continuing to unwind the male element 32 becomes completely inserted into the female element 31. The automatic attaching of the fish then being achieved, the role of the automatic handling device is thereafter to release the fish in such a way that the latter is pulled toward the sea by the drag line 13 to which it is attached.

For this purpose, it includes the following elements:

- a chassis 91 integrating the various elements of the device,
- a mobile support 92 on which the fish 11 enclosing the actual transmitter is positioned when it is not attached to the drag line 13 and from which it is separated after attachment,
- means (94-98) for displacing horizontally and vertically the mobile support 92 to a position where the fish 11 can be attached to the drag line,
- means 93 for separating the fish 11 from its support when the latter is attached to the drag line.

In the exemplary embodiment illustrated by FIGS. 9 to 12, the automatic handling device 22 is placed at the exit of the winch 14 so as not to impede the unwinding of the drag line 13. The fish 11 is placed on a mobile support 92 comprising two notches 93 forming calipers supporting the fish. The support 92 is arranged so as to be able to slide along two gangs of glideways, an upper gang 94 and a lower gang 95, placed on either side of the device. For this purpose it includes in particular means able to facilitate this gliding, such as for example gangs of roller bearings 96. The displacement of the support 92 along the glideways 94 and 95 is ensured by motor means 98, for example a controlled hydraulic ram, one end of which is fixed to the chassis of the device and the other end of which is fixed to the support.

According to an embodiment of the invention, the glideways 94 and 95 are arranged and profiled in such a way that the support 92 firstly follows a horizontal translational movement, on segments I lying between the points A and B, then a vertical translational movement, on segments II lying between the points B and C; then finally a movement of rearward tilting between the points C and D (portion III) of the glideways of the upper gang 94. For this purpose the portions AB and BC of the glideways 94 and 95 are rectilinear and of identical lengths and inclinations. The portion CD of the glideways 94, for its part, is a curved portion.

Figure 10:
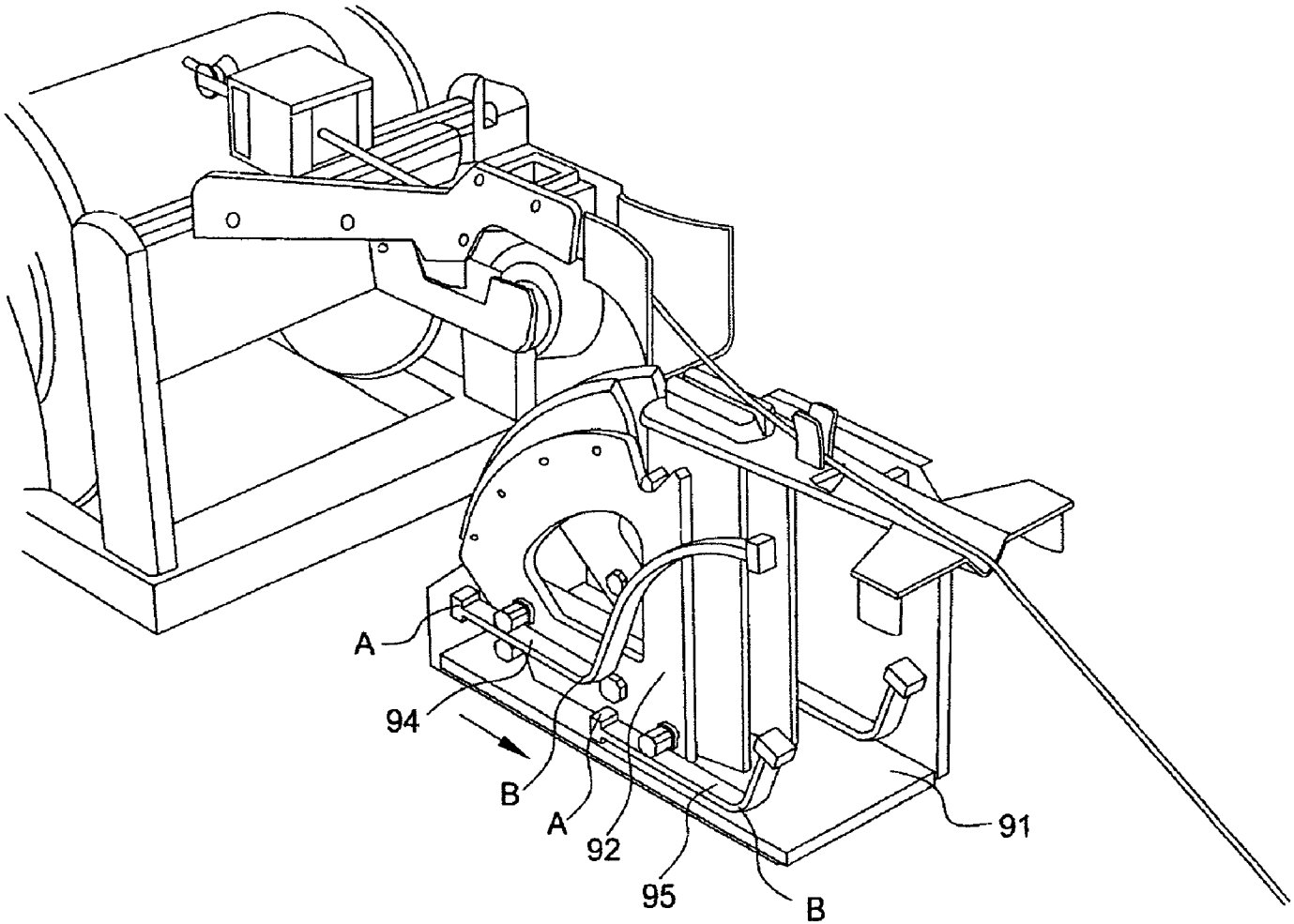

As illustrated by FIG. 10, the effect of the horizontal translational movement is to free the carriage from the underside of the winch, a position which serves moreover as a position for storing the fish on the deck of the carrier vessel. At the end of translation, the female element 31 is correctly positioned under the drag line 13. Thereupon, the drag line should be unwound in such a way that the line portion opposite the female element 31 is the portion 13-*a*.

Figure 11:
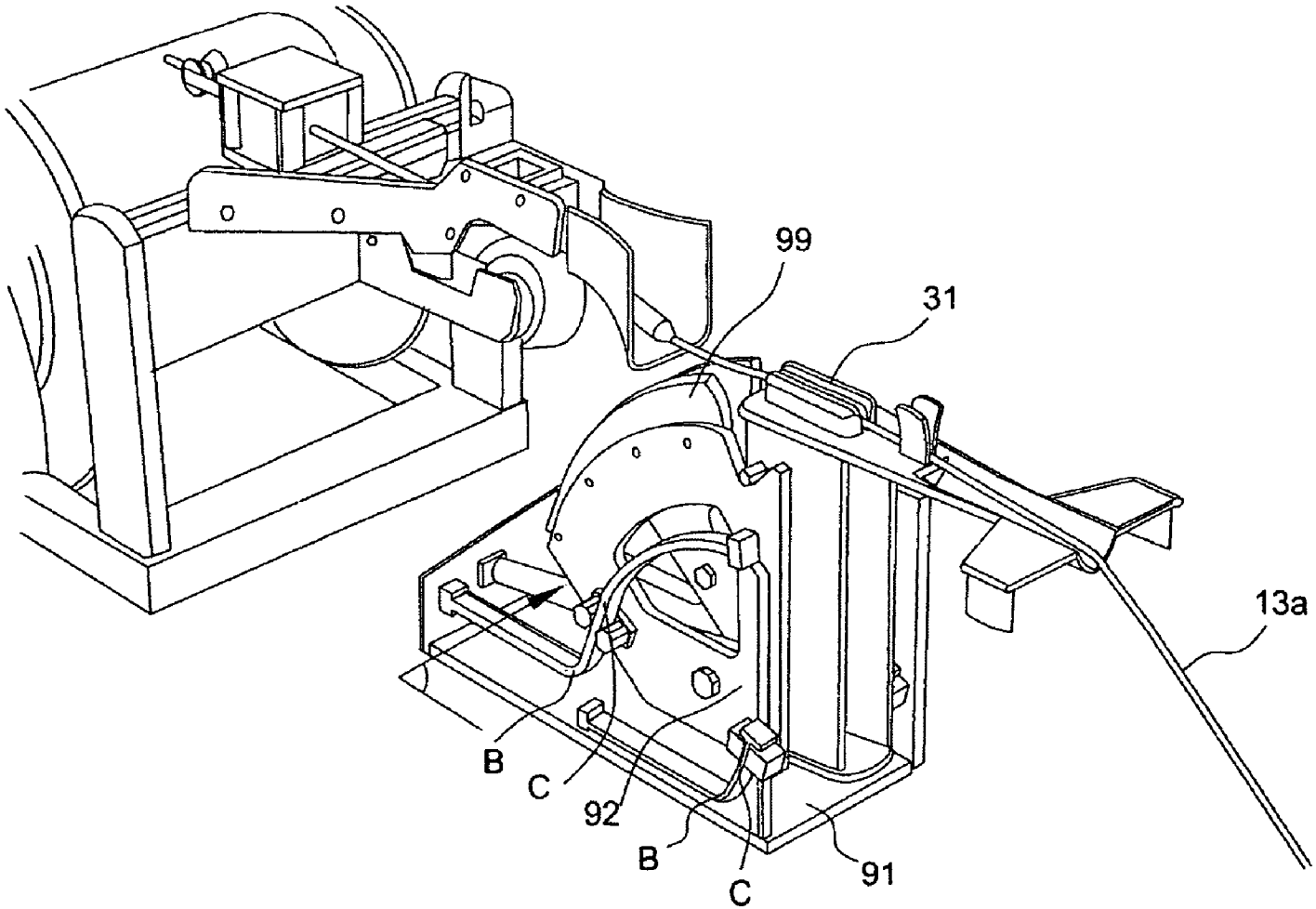

The vertical translational movement which follows makes it possible, as illustrated by FIG. 11, to position the drag line 13 in the female element 31 by raising the fish in such a way that it comes into contact with the line and that the latter becomes inserted into the female element 31.

At this juncture, automatic attaching is possible, the payout of the line into the element 31 leads automatically to the complete insertion of the male element 32 into the female element 31. This insertion can moreover be supplemented with an automatic latching of the element 32 in the element 31, it being possible for this latching to be carried out by any known means.

Figure 12:
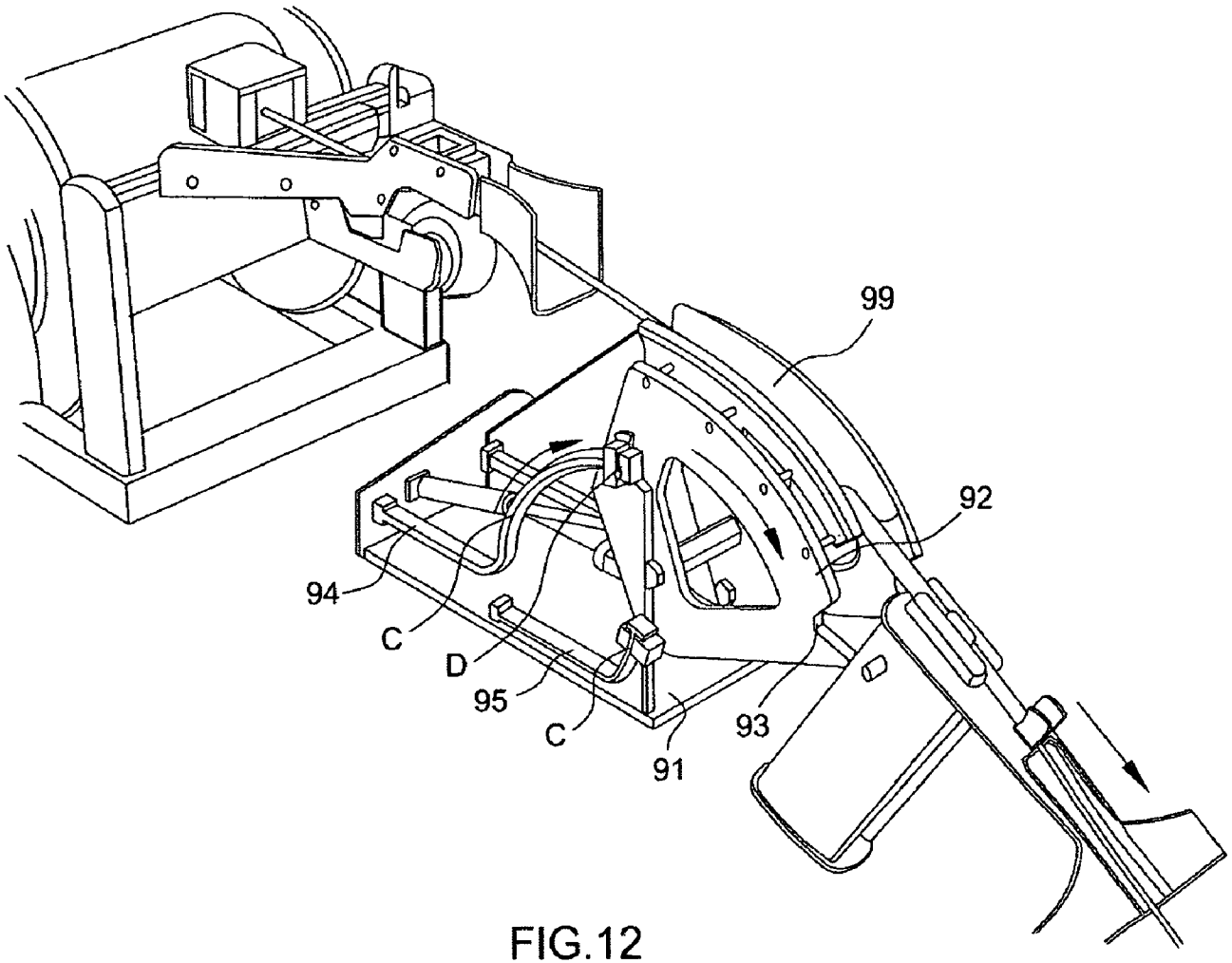

The rearward tilting movement, illustrated by FIG. 12, makes it possible to release, after attachment, the fish 11 from the notches 93 of the support 92. The fish can thus follow without impediment the immersion movement of the drag line 13 to which it is attached.

According to an embodiment of the invention the vertical translational movement, having brought the roller bearings 97 to the extremity of the glideways 95 (point C), the continuation of the movement of the roller bearings 96 along the glideways 94, which adopt a curved profile between the points C and D, advantageously induces a tilting of the support 92 about the rotation spindles including the ends of the glideways 95 which correspond to the points C. According to an embodiment of the invention, the support 92 is moreover maintained in the tilted position as long as the fish remains immersed.

Thus, as may be noted with the aid of FIGS. 9 to 12, the automatic handling device according to an embodiment of the invention advantageously makes it possible to position the fish 13 and the drag line 13 in relative positions which permits in an automatic manner, and without human intervention, the attaching and the electrical linking of the fish to the drag line. It is thus possible to place an active sonar into the sea or more generally to immerse any object having a similar mechanical structure, without resorting to human intervention. Advantageously, the chassis 91 of the handling device being positioned in a fixed manner on the handling platform of the vessel, the latter occupies relatively less room than a conventional handling means. Only the support 92 on which the transmitter is placed is mobile.

When the sonar is being recovered aboard or more generally when raising any object having a similar mechanical structure out of the immersion medium, the drag line is wound on the winch so that at a given instant the fish 11 is positioned in contact in the notches 93. From this instant, the motor means 98 induce a movement of the support from the position D to the position C, so that the support 92 follows a forward tilting movement and so that the fish is again immobilized on its support. Accordingly, the winding of the drag line on the winch leads to an extraction of the male element 32 out of the female element 31, which extraction leads to the mechanical detaching and to the electrical disconnection of the fish. The line thereafter continues its winding around the drum of the winch 14. The motor means 98 thereafter drive the support 92 in a vertical translational movement from the position C to the position B and then in a horizontal translational movement up to the position A, in which position the support and the fish, both housed under the exit of the winch 14, no longer constitute for example an impediment to the hauling-in of the linear reception antenna 12.

In this way, the automatic handling device according to an embodiment of the invention also advantageously allows the recovery of the sonar, the detaching and the storage of the fish without resorting to any human intervention.

It should be noted that, as was stated previously, the automatic attaching device 21 according to an embodiment of the invention can be supplemented with an automatic latching and unlatching means, the object of which is to maintain, in the latched position, the male element 32 in a position where it is completely inserted into the female element 31. This device can for example including a snap-fastening device for which latching is performed automatically when the element 32 is completely inserted into the element 31. Accordingly, unlatching can for example be activated, during the sonar recovery maneuver, by the rearward tilting of the support 92 and the immobilization of the fish in the notches 93.

It should also be noted that, as illustrated by FIGS. 9 to 12, the mobile support 92 can also include guidance means 99 which limit the excessive curvature of the drag line which can intervene after attaching the fish, when the line portion carrying the fish is being launched into the water. These means 99 constitute a curved groove which comes into position under the drag line 13 when the mobile support 92 is in position D, so as to serve as guide and curvature limiter for the drag line and to avoid damage to the line following too high a curvature imposed in particular by the weight of the fish 11.

The invention claimed is:

1. A system for automatically attaching and handling a submersible object having at least one transmission antenna, towed by a tow line, wherein the system comprises:

at least one automatic attaching device to removably mechanically attach the submersible object to a drag line and to link the submersible object to a structure conveying signals and energy in the drag line, the automatic attaching device comprising:

a male element secured to one of the drag line and the submersible object; and a female element secured to one of the drag line and the submersible object, which is not already secured to the male element, wherein:

the male element is configured to fit in the female element, to secure the female element to the drag line; and insertion of the male element into the female element is carried out automatically by sliding the drag line into the female element.

2. The system as claimed in claim 1, wherein the male element and the female element of the automatic attaching device each comprise connectors, able to plug into one another.

3. The system as claimed in claim 1, wherein the female element of the automatic attaching device forms a tubular cavity able to receive the male element, the female element comprising:

two axial openings of which at least one axial opening has a cross section sufficient to allow insertion of the male element; and a lateral opening having a width, substantially equal to a diameter of the drag line, to allow insertion of the drag line into the cavity.

4. The system as claimed in claim 3, wherein the cross section of the male element of the automatic attaching device is greater than the cross section of the drag line to which the male element is secured, to prevent the male element from passing through the lateral opening of the female element.

5. The system as claimed in claim 1, wherein:

the male element of the automatic attaching device has a substantially cylindrical form, the substantially cylindrical form having an axis of symmetry that substantially coincides with an axis of symmetry of the drag line, the substantially cylindrical form further having a diameter substantially greater than the diameter of the drag line; and the female element of the automatic attaching device comprising a cavity to form a cylindrical tube, the cylindrical tube having a sufficient diameter to allow the axial insertion of the male element.

6. The system as claimed in claim 2, wherein the male element and the female element of the automatic attaching device further comprise:

one of a first and second structure configured and arranged so that the insertion of the male element into the female element positions the connectors of the male element opposite to the connectors of the female element and facilitates attachment of connectors placed opposite.

7. The system as claimed in claim 6, wherein the first and second structure are configured to allow a relative rotational movement between the male element and the female element in order to produce a predetermined orientation of the male and female elements.

8. The system as claimed in claim 7, wherein the first and second structure comprise a first and second plurality of fingers implanted respectively on the periphery of the male element and on the internal wall of the cavity of the female element, the plurality of fingers of the male element being configured to be housed in spaces separating the plurality of fingers of the female element when the male element is inserted into the female element.

9. The system as claimed in claim 8, wherein the plurality of fingers implanted on the male element have a different end profile from that of the plurality of fingers implanted on the female element, so that a bringing together of the first and second plurality of fingers causes the first plurality of fingers to glide along the second plurality of fingers.

10. The system as claimed in claim 1, further comprising an automatic device for handling the submersible object, said automatic device comprising:

a carrier chassis fixed to the handling platform of a vessel, the carrier chassis having a first and second lateral side;

a mobile support on which the submersible object is positioned when it is not attached to the drag line and from which the submersible object is separated after attachment;

a diplacer to displace the mobile support horizontally and vertically and to guide the mobile support from a standby position to a position to allow automatic attaching of the submersible object to the drag line or conversely from attachment of the submersible object to the drag line to the standby position and an apparatus to release the submersible object from its mobile support when the latter is attached to the drag line and to replace the submersible object on the support after detachment, wherein the device is positioned in a fixed manner on the handling platform.

11. The system as claimed in claim 10, wherein the displacer further comprises:

a motor to move the mobile support;

one or more upper lateral glideways, placed on each of the first and second lateral sides of the carrier chassis, each upper lateral glideway comprising:

a first rectilinear segment having first and second ends, the first end forming a first abutment, the first rectilinear segment being substantially horizontal;

a second rectilinear segment having first and second ends, the second rectilinear segment being substantially vertical, the first end of the second rectilinear segment curvedly joined to the second end of the first rectilinear segment; and a curved segment having first and second ends, the first end of the curved segment smoothly joined to the second end of the second rectilinear segment, and the second end of the curved segment forming a second abutment;

one or more lower lateral glideways, placed on each of the first and second lateral sides of the carrier chassis below the upper lateral glideways, each lower lateral glideway comprising:

a third rectilinear segment having first and second ends, the third rectilinear segment being substantially horizontal, the first end forming a third abutment; and a fourth rectilinear segment having first and second ends, the fourth rectilinear segment being substantially vertical, the first end of the fourth rectilinear segment curvedly joined to the second end of the third rectilinear segment, and the second end of the fourth rectilinear segment forming a fourth abutment;

wherein the displacer is arranged and cooperating so that the mobile support, gliding along the first and second glideways follows:

first, a horizontal translational movement along the first and third rectilinear segments;

second, a vertical translational movement along the second and fourth rectilinear segments; and third, the fourth abutment forms a rotation spindle, to facilitate a tilting along the curved segment of the upper glideway.

12. The system as claimed in claim 10, wherein the mobile support of the automatic handling device comprises an apparatus to maintain the submersible object in place when the mobile support is in an untilted position and to allow release of the submersible object when the mobile support is in a tilted position.

13. The system as claimed in claim 12, wherein the apparatus to maintain the submersible object in place includes notches made in flanks of the mobile support.

14. The system as claimed in claim 11, wherein the motor of the automatic handling device includes a controlled hydraulic ram, one end of which is fixed to the chassis of the device and the other end of which is fixed to the mobile support.

15. The system as claimed in claim 10, wherein the mobile support comprises a curved groove which comes into position under the drag line when the mobile support is in a tilted position, to guide the drag line and limit its curvature.

* * * * *